United States Patent [19]

Igarashi et al.

[11] 4,416,939

[45] Nov. 22, 1983

[54] HEAT-SENSITIVE RECORDING PAPER

[75] Inventors: Akira Igarashi; Sukenori Nakamura, both of Fujinomiya, Japan

[73] Assignee: Fuji Photo Film Co., Ltd., Kanagawa, Japan

[21] Appl. No.: 339,231

[22] Filed: Jan. 13, 1982

[30] Foreign Application Priority Data

Jan. 13, 1981 [JP] Japan ..... 56-3486

[51] Int. Cl.[3] ..... B41M 5/18

[52] U.S. Cl. ..... 428/323; 162/162; 282/27.5; 428/327; 428/336; 428/409; 428/537; 428/913

[58] Field of Search ..... 282/27.5; 427/150, 151; 428/320.4, 320.6, 320.8, 409, 488, 530, 531, 537, 913, 914, 323, 327, 336; 162/162

[56] References Cited

U.S. PATENT DOCUMENTS 4,255,491 3/1981 Igarashi ..... 428/537

*Primary Examiner*—Bruce H. Hess

*Attorney, Agent, or Firm*—Sughrue, Mion, Zinn, Macpeak & Seas

[57] ABSTRACT

A heat-sensitive recording paper is disclosed having improved heat-transmission efficiency between a recording element and the heat-sensitive recording paper. The disclosed heat-sensitive recording paper includes a support base paper having an aqueous-sensitive developable layer coated thereon. In the base paper used, the value obtained by dividing Stöckigt sizing degree by a square number of meter areal weight is $3\times10^{-3}$ ($S.m^4/g^2$) or more and Bekk smoothness of 90 seconds or more. The aqueous heat-sensitive developable layer coated on the surface of the base support includes a dispersion of particles having a volume average particle size of 8 μm or less, said layer being coated on the surface of the base support to a thickness of 5 to 10 μm. The unique base paper disclosed can be obtained by increasing the beating degree of the pulp, using a strong sizing agent or increasing the amount of sizing agent, or surface sizing or coating the heat-sensitive developable layer, or any combination of these methods.

6 Claims, No Drawings

HEAT-SENSITIVE RECORDING PAPER

FIELD OF THE INVENTION

The present invention relates to heat-sensitive recording paper. More specifically, the present invention relates to a heat-sensitive recording paper comprised of an aqueous heat-sensitive developable layer coated on a surface of a base paper.

BACKGROUND OF THE INVENTION

The heat-sensitive recording paper means sheets wherein images are formed by utilizing a physical or chemical change of substances by means of thermal energy.

Examples of heat-sensitive recording paper utilizing a physical change of substances by heat is the so-called wax type heat-sensitive recording sheet which is utilized for electrocardiograms. Heat-sensitive recording papers which utilize a chemical change by heat include those utilizing coloration or discoloration of a specified compound by heat and those utilizing a color reaction of two or more substances by heat. Examples of heat-sensitive recording papers utilizing a color reaction of two or more substances include those using a combination of ferric salt of higher fatty acids such as stearic acid and polyhydric hydroxy aromatic compounds (U.S. Pat. Nos. 2,663,654 to 2,663,657), those forming azo dyes or oxazine dyes from dye forming material (Japanese Patent Publication No. 9240/63) and those using a combination of a colorless dye such as Crystal Violet lactone, etc., and a phenol compound (Japanese Pat. No. 4160/68 and U.S. Pat. Nos. 3,451,338, 3,539,375, 3,674,535 and 3,666,525), etc.

Heat-sensitive recording papers do not require development because of primary coloration. Therefore, they are advantageous in that the recording apparatus is light and small-sized. Consequently they have been broadly utilized recently. On the other hand, they are undesirable because the recording speed is not sufficiently high. The response speed of the recording element is limited because the recording energy is heat. In order to overcome this drawback, various efforts have been made in the areas of both the recording apparatus and the recording paper. One method involves increasing the smoothness of a surface of the heat-sensitive recording paper as described in Japanese Patent Publication No. 20142/77 and Japanese Patent Application (OPI) No. 47351/73 (the term "OPI" as used herein refers to a "published unexamined Japanese patent application"). Generally, in order to increase the smoothness of the heat-sensitive recording paper, a surface treatment is carried out by supercalendering, by which heat-transmission efficiency between the recording element and the heat-sensitive recording paper is improved. This contributes to an increase of recording speed.

However, surface treatment for improving smoothness has various drawbacks. One drawback is fogging. More specifically, a color reaction occurs during the surface treatment by which the recording paper is slightly colored. As a counterplan, it has been proposed to add granular waxes (Japanese Patent Publication No. 14531/75). However, waxes generally have a large heat capacity and high heat of fusion, by which heat-response of the heat-sensitive recording paper deteriorates, causing problems.

Another drawback of increasing smoothness is that the ability to write on the paper with pencils or ball point pens, etc., deteriorates. This drawback is expected because writing depends upon friction between the writing means and the paper. Still another drawback is difficulty during the processing step. More specifically, production efficiency is greatly deteriorated because supercalendering is carried out on off-machine in most cases but not carried out continuously into a coating step. Yet another drawback is that adhesion of the recording paper to the recording element occurs on the developed parts, because the recording element closely contacts with the recording paper, by which the running property deteriorates due to sticking.

In spite of various drawbacks, the fact is that the surface treatment to increase smoothness is nearly always carried out, because the improvement of smoothness comparatively contributes to the improvement of the recording speed.

SUMMARY OF THE INVENTION

An object of the present invention is to provide a heat-sensitive recording paper having remarkably excellent heat-transmission efficiency between the recording element and the heat-sensitive recording paper without causing the above described drawbacks.

Another object of the present invention is to provide a heat-sensitive recording paper capable of carrying out high-speed recording.

As a result of various investigations in order to achieve these objects, it has now been found that the heat-sensitive recording paper having remarkably excellent heat-transmission efficiency and consequently capable of carrying out high-speed recording is obtained by providing a heat-sensitive developable layer on a surface of base paper wherein the value obtained by dividing Stöckigt sizing degree determined by JIS-P-8122 by a square number of meter areal weight determined by JIS-P-8124 is $3\times10^{-3}$ ($S.m^4/g^2$) or more and Bekk smoothness determined by JIS-P-8119 is 90 seconds or more. This invention cannot be attained, if the base paper is lacking in one of these two requirements.

DETAILED DESCRIPTION OF THE INVENTION

In the base paper used in the present invention, the value obtained by dividing Stöckigt sizing degree by a square number of meter areal weight is $3\times10^{-3}$ ($S.m^4/g^2$) or more and preferably $4\times10^{-3}$ ($S.m^4/g^2$) or more and Bekk smoothness is 90 seconds or more and preferably 150 seconds or more. Such base paper preferably has a thickness of about 40 to 200 μm, more preferably 50 to 150 μm. Such base paper can be obtained by (1) increasing the beating degree of pulp, (2) using a strong sizing agent or increasing the amount of a sizing agent or (3) surface sizing or coating of the heat-sensitive developable layer, or by combinations of (1), (2) and (3), as described in *The Journal of Technical Association of Pulp and Paper Industry,* Tappi, Vol. 58, No. 3, pages 48 to 57; Vol. 60, No. 10, pages 102 to 105; and Vol. 62, No. 7, pages 35 to 38.

The aqueous heat-sensitive coating solution used in the present invention is prepared by finely dispersing a heat-sensitive color forming material in water as a dispersion medium. More specifically, dispersions are prepared by finely dispersing an electron donative colorless dye such as Crystal Violet lactone and an electron acceptable compound such as 2,2-bis(4-hydroxyphenyl)propane in an aqueous solution of polyvinyl alcohol so as to have a particle size of less than several microns. Processes for producing them have been described in Japanese Patent Publication No. 14039/70, Japanese Patent Application (OPI) No. 93492/80 and Japanese Patent Application (OPI) No. 14281/80. It is preferred that dispersed particles contained in the heat-sensitive coating solution have a volume average particle size of 8 μm or less and preferably 4 μm or less. This reason is that, since the heat-sensitive developable layer is generally formed so as to have a thickness of 5 to 10 μm, sufficient smoothness cannot be obtained, even if the base paper of the present invention is used, when large particles are contained.

In the following, an example is described. However, the present invention is not limited to it.

EXAMPLE 20 kg of Crystal Violet lactone was dispersed in a 10% aqueous solution of polyvinyl alcohol (saponification value: 98%, degree of polymerization: 500) by processing in a 300 *l* ball mill for 24 hours. Similarly, 20 kg of 2,2-bis(4-hydroxyphenyl)propane was dispersed in a 10% aqueous solution of polyvinyl alcohol by processing in a 300 *l* ball mill for 24 hours. Both dispersions are blended so that a ratio of Crystal Violet lactone to 2,2-bis(4-hydroxyphenyl)propane was 1:5 by weight. Further, 5 kg of light finely-divided calcium carbonate was added to 20 kg of the resulting mixture and sufficiently dispersed to obtain a coating solution. The resulting heat-sensitive coating solution was applied to base papers having various kinds of Stöckigt sizing degree, areal weight and degree of smoothness, by an air knife so as to have a coating amount of 6 g/m$^2$ as a solid content. After being dried at 50° C. for 2 minutes, recording was carried out by applying energy of 2 ms/dot and 50 mJ/mm$^2$ at a density of main scanning: 5 dots/mm and sub scanning: 6 dots/mm to a recording element, and a reflection density at 610 nm (maximum absorption wavelength of developed Crystal Violet lactone) was measured. Results are shown in Table 1. Further, a density in case of developing after a calender treatment was shown, too.

It is understood from the table that the heat-sensitive recording paper of the present invention shows remarkably excellent recording characteristics.

In general, it is preferred as a recording characteristics that the color density is 0.90 or more and the fog is less than 0.10.

TABLE 1

| No. | Areal Weight (g/m$^2$) | Stöckigt Sizing Degree (S) | Degree of Smoothness (S) | Stöckigt Sizing Degree / Areal Weight (S · m$^4$/g$^2$) | Calender Treatment*[1] | Fog | Color Density | Writability to Pencil | Note |
|---|---|---|---|---|---|---|---|---|---|
| 1 | 41.6 | 3 | 110 | $1.7 \times 10^{-3}$ | Nothing | 0.08 | 0.60 | Good | Comparison |
| 2 | 50.8 | 4 | 120 | $1.6 \times 10^{-3}$ | Nothing | 0.08 | 0.62 | Good | Comparison |
| 3 | 51.2 | 4 | 110 | $1.5 \times 10^{-3}$ | Enforcement | 0.11 | 0.81 | Inferior | Comparison |
| 4 | 52.3 | 9 | 110 | $3.3 \times 10^{-3}$ | Nothing | 0.08 | 0.90 | Good | This Invention |
| 5 | 51.8 | 13 | 120 | $4.8 \times 10^{-3}$ | Nothing | 0.08 | 1.02 | Good | This Invention |
| 6 | 52.1 | 10 | 170 | $3.6 \times 10^{-3}$ | Nothing | 0.08 | 0.98 | Good | This Invention |
| 7 | 58.9 | 9 | 130 | $2.6 \times 10^{-3}$ | Nothing | 0.08 | 0.71 | Good | Comparison |
| 8 | 59.2 | 13 | 130 | $4.6 \times 10^{-3}$ | Nothing | 0.08 | 1.00 | Good | This Invention |
| 9 | 76.0 | 20 | 65 | $3.5 \times 10^{-3}$ | Enforcement | 0.11 | 0.93 | Inferior | Comparison |
| 10 | 76.1 | 48 | 120 | $8.3 \times 10^{-3}$ | Nothing | 0.08 | 1.11 | Good | This Invention |
| 11 | 76.5 | 51 | 190 | $8.7 \times 10^{-3}$ | Nothing | 0.08 | 1.22 | Good | This Invention |
| 12 | 76.0 | 46 | 70 | $7.9 \times 10^{-3}$ | Nothing | 0.08 | 0.79 | Good | Comparison |
| 13 | 101 | 70 | 55 | $6.9 \times 10^{-3}$ | Nothing | 0.08 | 0.72 | Good | Comparison |
| 14 | 100 | 53 | 110 | $5.3 \times 10^{-3}$ | Nothing | 0.08 | 1.08 | Good | This Invention |
| 15 | 101 | 88 | 200 | $8.6 \times 10^{-3}$ | Nothing | 0.08 | 1.21 | Good | This Invention |

*[1]Supercalender: 50 kg w/cm × 10 m/min

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

a base paper wherein a value obtained by drividing a Stöckigt sizing degree determined by JIS-P-8122 by areal weight (g/m$^2$) determined by JIS-P-8124 is $3 \times 10^{-3}$ (S.m$^4$/g$^2$) or more and the base paper having a Bekk smoothness determined by JIS-P-8119 of 90 seconds or more; and an aqueous heat-sensitive developable layer coated on a surface of said base paper.

2. A heat-sensitive recording paper as claimed in claim 1, wherein said value obtained by dividing a Stöckigt sizing degree determined by JIS-P-8122 by areal weight determined by JIS-P-8124 is $4 \times 10^{-3}$ (S.m$^4$/g$^2$) or more.

3. A heat-sensitive recording paper as claimed in claim 1, wherein said Bekk smoothness determined by JIS-P-8119 is 150 seconds or more.

4. A heat-sensitive recording paper as claimed in claim 1, wherein said aqueous heat-sensitive developable layer includes dispersed particles having an average volume particle size of 8 μm or less.

5. A heat-sensitive recording paper as claimed in claim 4, wherein said particles have a volume average size of 4 μm or less.

6. A heat-sensitive recording paper as claimed in claim 1, wherein said heat-sensitive developable layer has a thickness of 5 to 10 μm.

* * * * *